United States Patent [19]

Umstead

[11] 4,179,049

[45] Dec. 18, 1979

[54] PUMP DISPENSER

[75] Inventor: Herbert R. Umstead, Warwick, N.Y.

[73] Assignee: Avon Products, Inc., New York, N.Y.

[21] Appl. No.: 872,544

[22] Filed: Jan. 26, 1978

Related U.S. Application Data

[63] Continuation-in-part of Ser. No. 792,414, Apr. 29, 1977, abandoned.

[51] Int. Cl.[2] ..... B05B 7/32

[52] U.S. Cl. ..... 222/631; 222/321; 222/380

[58] Field of Search ..... 222/193, 321, 383, 380; 237/333, 431

[56] References Cited

U.S. PATENT DOCUMENTS

| | | | |
|---|---|---|---|
| 3,239,151 | 3/1966 | Boris | 239/333 |
| 4,051,983 | 10/1977 | Anderson | 239/333 X |
| 4,057,176 | 11/1977 | Horvath | 222/321 X |

*Primary Examiner*—Robert J. Spar
*Assistant Examiner*—Frederick R. Handren
*Attorney, Agent, or Firm*—Pennie & Edmonds

[57] ABSTRACT

A dispenser apparatus for receipt on a receptacle and operable to dispense a volume of liquid from a reservoir through an orifice includes means for injecting air into the liquid being dispensed to increase the level of atomization. The means includes a secondary chamber which normally is open to atmosphere yet adapted to be pressurized upon actuation of the pumping mechanism of the dispenser. The secondary chamber interior communicates through an opening with the liquid flow path to the orifice. The secondary chamber provides a secondary pump isolated from, but synchronized with the primary pumping mechanism.

3 Claims, 3 Drawing Figures

FIG. 1.
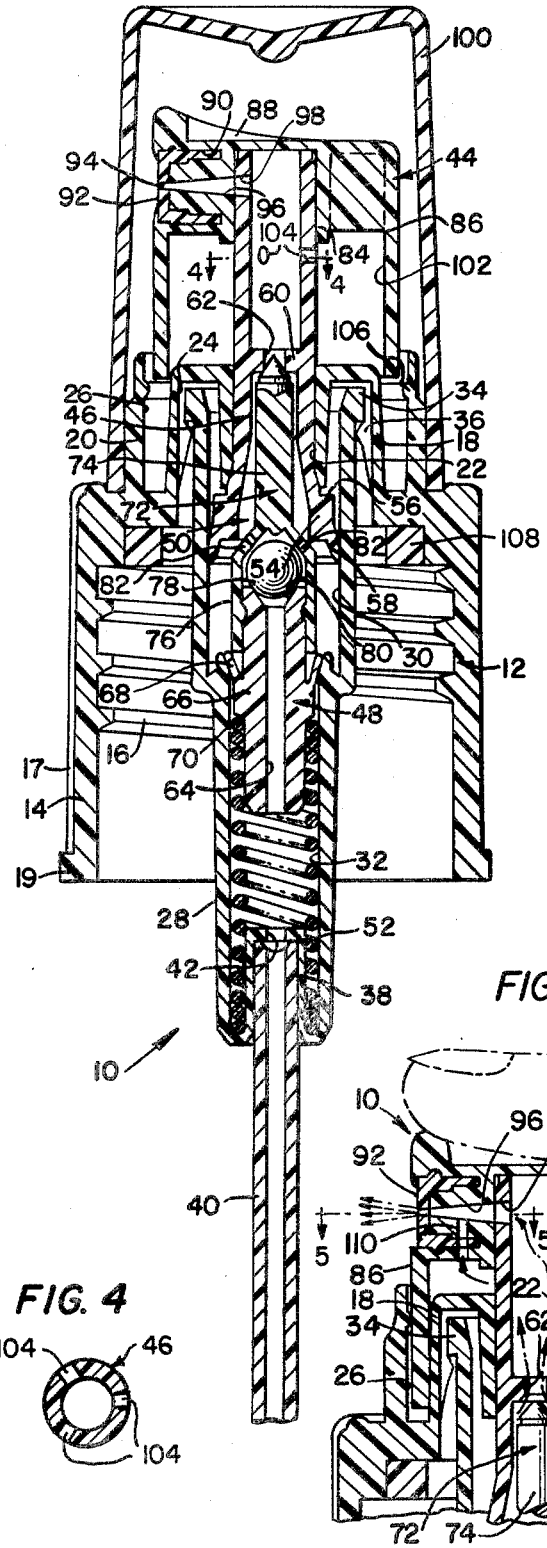
FIG. 2.
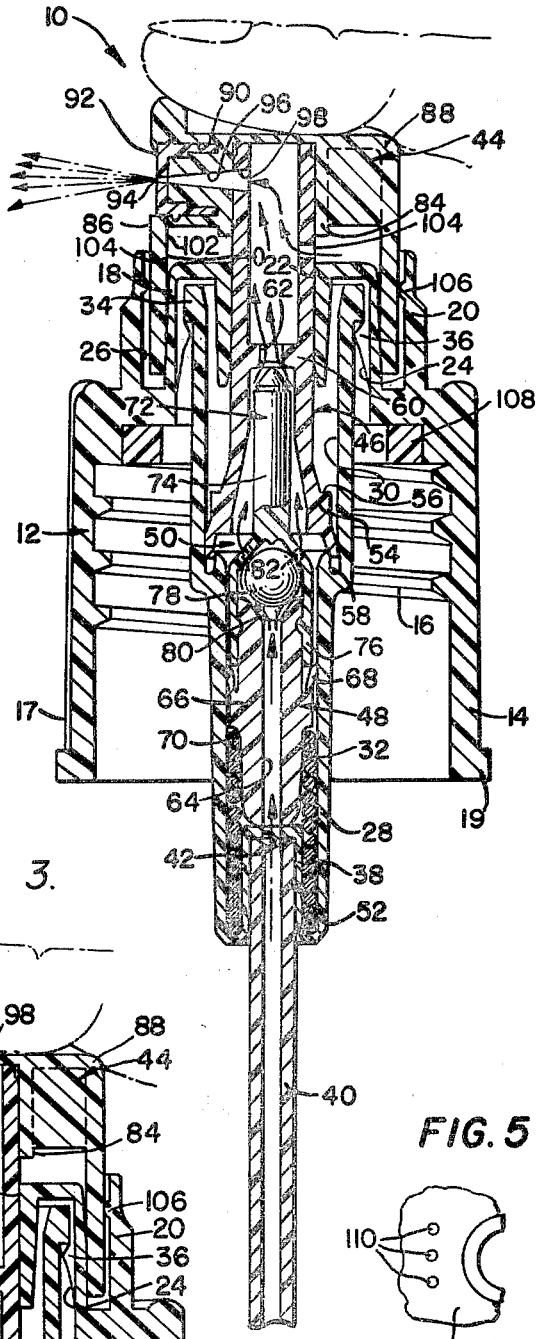
FIG. 3.
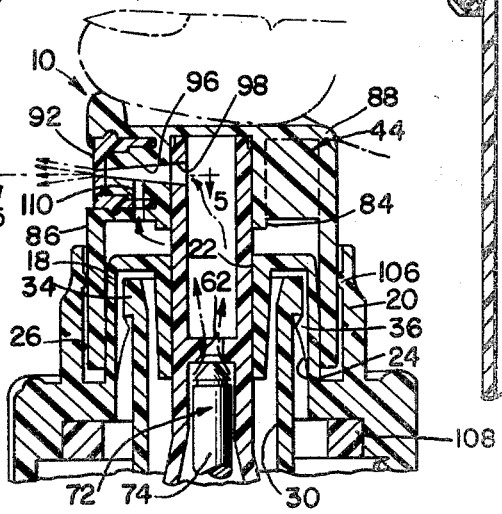
FIG. 4
FIG. 5
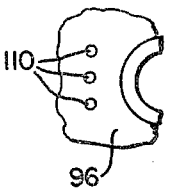

PUMP DISPENSER

REFERENCE TO RELATED APPLICATIONS

The present application is a continuation-in-part of application Ser. No. 792,414, filed Apr. 29, 1977, and now abandoned.

BACKGROUND OF THE INVENTION

In today's market there are many forms of dispenser apparatus which through a pumping mechanism communicate liquid from a reservoir in a receptacle, such as a bottle or the equivalent, to an orifice. The dispensers overall have been capable of passing liquid from the orifice in dose, spray or atomized form, the latter action, however, being limited to liquids of relatively low viscosity in the range of only a few centipoises or those liquids which contain no polymers of high molecular weight such as may be found in consumer-type household products of the cosmetic and cleaning variety.

When the liquid to be discharged from the orifice is of a higher viscosity or one which may be difficult to atomize because of the presence of high molecular weight constituents the industry has resorted to the use of propellants to achieve atomization of the liquid. The use of these propellants now is being studied in view of the possibility that their use has a detrimental effect on the environment.

BRIEF DESCRIPTION OF THE INVENTION

It is accordingly a principal object of the present invention to provide a dispenser of improved operating capability thereby to dispense in an atomized state without resort to a propellant liquids having a viscosity of from about 3 centipoises up to and including about 900 centipoises, as well as those liquids which may be of a relatively low viscosity but difficult to atomize because of their constituent make-up which may include polymers of high molecular weight of about $10^5$ to about $10^6$. Included in this category are hairsprays, anti-perspirants and cleaners such as oven cleaners, only to name a few.

While the invention will be described with particularity below in conjunction with a discussion of the figures of drawing, it resides in the provision in a dispenser apparatus of a secondary pump which is synchronized with the primary pumping mechanism thereby to inject air into thereby to mix with and atomize the liquid being dispensed from an orifice. The improved dispenser apparatus serves to enhance markedly the mechanical break-up by creating a condition of turbulence in the liquid, without resort to a propellant, and the dispenser apparatus can operate with liquids having a viscosity over a wide range, as above, or those liquids including polymers of high molecular weight, also as discussed above. As used herein "propellant" is a characterization of fluorohydrocarbon-type mediums.

Briefly, the primary pumping mechanism of the dispenser apparatus includes piston and valve means actuated by a finger-engaged button thereby upon pressing to create a pressure differential in a cylinder for purposes of opening a valve to communicate a liquid in the reservoir of the receptacle to an orifice. The finger engaged button forms with the structure of the cylinder a secondary chamber which normally is open to the atmosphere yet when actuated against the pressure of a spring is sealed, except for an orifice connecting the secondary chamber to the path of flow of the dispensed liquid. The finger engaged button provides the secondary pump and through pressurization of the secondary chamber air will be injected into the liquid. Preferably, the air is communicated to the liquid through an orifice located externally of the primary pumping mechanism and various alternative arrangements of communication may be resorted to.

Other objects and advantages of the present invention will be perceived as the description continues.

DESCRIPTION OF THE DRAWING

FIG. 1 is a view in elevation and almost entirely in section of the improved dispenser apparatus of the present invention, the parts being in a non-actuated position;

FIG. 2 is a view similar to FIG. 1, the parts, however, being in an actuated position;

FIG. 3 is a partial showing of the improved dispenser apparatus illustrating a modification of the structure of FIGS. 1 and 2;

FIG. 4 is a view in section as seen along the line 4—4 in FIG. 1; and, FIG. 5 is a view in section as seen along the line 5—5 in FIG. 3.

DESCRIPTION OF THE PREFERRED EMBODIMENT

The improved dispenser apparatus (hereinafter "dispenser") of plunger-type may be seen to advantage in the drawing, in which FIG. 1 illustrates the parts of the dispenser in the nonactuated condition, while FIG. 2 illustrates the parts, the cap having been removed, in a condition of actuation for dispensing a volume of liquid, as aforedescribed, from a receptacle such as a bottle (not shown).

The dispenser 10 includes a body 12 of cap-like configuration capable of receipt on the bottle. To this end, the body includes a skirt 14 provided throughout a portion of its length with an internal thread 16 for securement of the body on a threaded length along the neck of the bottle. A plurality of vertical ribs 17 on the outer surface of the skirt assist in gripping the body for threading it on the neck. The body also includes a hub 18 and a sleeve 20 for purposes to be discussed.

The lower rim 19 of the skirt is enlarged for added rigidity.

The hub, in section, is of U-shape outline to bound a central opening 22 and form a channel 24 which opens downwardly concentrically therearound. The sleeve which is arranged concentrically outwardly of the hub forms with the hub a second channel 26 which is oppositely directed.

The dispenser also includes a cylinder 28 having a pair of chambers 30 and 32, the latter of which is of a smaller internal diameter therealong. The chambers of the cylinder communicate with each other and the cylinder is open at both ends. One open end is received on the body 12 and the other open end provides an entrance to the cylinders for liquid to be dispensed.

Many assembly techniques may be resorted to in the mounting of the cylinder to the body. In the preferred embodiment of the invention, the cylinder includes an annular lip 34 and the outer surface of channel 24 is formed with an annular rib 36 over which the lip may snap. The natural resilience of the material of the cylinder which may be formed of plastic such as polypropylene permits the necessary inward flex so that the lip will pass over the rib yet the memory of the material will return it to the unflexed state immediately thereafter for securement of the parts. The other end of the cylinder is formed to provide a hollow projecting portion 38 extending into chamber 32. The hollow projecting portion is shaped to define an annular channel between its surface and the inner surface of chamber 32. The inner wall of the projecting portion provides a supporting surface for a tube 40. The tube may be adhesively or frictionally secured along the supporting surface. An aperture 42 communicates the chamber 32 with tube lumen.

The dispenser also includes an actuator 44, a pair of pistons 46 and 48 movable within the chambers 30 and 32, respectively, a valve assembly 50 and a compression spring 52 which serves to bias the actuator to the FIG. 1 position.

The piston 46 is formed by a member generally of H-shape in cross-section having a cylindrical wall which throughout its length from one end substantially is of uniform diameter. The piston at the other end is enlarged at 54 with an upper shoulder 56 and a portion 58 which extends somewhat outwardly and downwardly to frictionally wipe along the wall of chamber 30 thereby to provide a seal. The piston is movable along and supported within the opening 22 in hub 18. Both the wall of the piston and the inner surface of the hub 18 at the opening 22 are beveled, the surfaces interacting to decelerate the piston 46 in return to the non-actuated position under spring pressure and overcome the condition of rapid stopping as would occur if shoulder 56 moved without deceleration into contact with the rim of hub 18.

A ring 60 is formed between the ends of the piston, the surface around the center opening 62 forming a seat for a valve of valve assembly 50 for opening and closing the liquid flow path.

The piston 48 moves within and seals the chamber 32. The piston includes a central passage 64 providing a liquid flow path and a peripheral ringed region 66 formed with a portion 68 and a shoulder 70, both of which may be likened to the shoulder 56 and portion 58 within the enlargement 54 of piston 46. Thus, the portion 68 extends somewhat outwardly and upwardly to frictionally wipe along the wall of chamber 32 thereby to provide a seal. The shoulder 70 supports one end of compression spring 52, the other end being supported at the base of the cylindrical surface 38.

The valve assembly 50 includes a valve 72 having a spiked end 74 and a cup-like end 76. The valve is mounted on piston 48 which is received into the cup-like end and secured by means of a plurality of interacting ridges and grooves. Thus, the piston 48 and valve assembly move as one. A spherical check valve 78 is captured in a pocket closed by the piston 46. The check valve normally rests upon a seat 80 to seal the passage 64 although under pressure it moves away from the seat to communicate the passage with the chamber 30 through one or more openings 82 in the valve. As may be seen, the size of the check valve is such to permit the flow of liquid therearound.

The actuator 44 may be integral with the piston 46 but preferably is received on the piston at the open end. To this end, the actuator includes a sleeve 84 of a size to receive the open end of the piston. The piston is closed by a finger engaging surface 88 of the actuator. A skirt portion 86 is disposed concentrically outwardly of the sleeve. A portion of the body of the actuator is cut to provide a channel 90 into which a cup 92 having an orifice 94 is received. A passage 96 in the body of the actuator communicates with the orifice and an opening 98 in the piston 46 whereby liquid may be dispensed. A cap 100 may be received on the body by telescoping over the sleeve 20 to prevent inadvertent use of the dispenser.

The structure described above comprises both the primary and secondary pumping mechanisms, the latter of which is an important aspect of the invention only being generally described to this point.

We turn now to the features of the secondary pump and its manner of operation in concert with the primary pump. The secondary pump includes an annular chamber 102, the volumetric capacity of which is defined by the radial distance between the inner wall of skirt 86 and the outer wall of the stem of piston 46 and the axial spacing of the body of the actuator (in the FIG. 1 position) and the upper surface of hub 18.

In one form of the invention, the form of FIGS. 1 and 2, one or more openings 104 (hereinafter "stem opening") provide means to communicate air under pressure from chamber 102 to the stem of piston 46 through which liquid flows from the receptacle, the liquid flow indicated by the directional arrows in FIG. 2. The arrows in the figure, also, indicate the flow of air from chamber 102, through stem opening 104 thereby to provide mechanical break-up and turbulence of the liquid for purposes described. The stem opening may be located along the length of the stem as determined by the length of the stroke of piston 46. A particularly desirable location is closely adjacent the body of the actuator. In the form of the invention illustrated in FIG. 3, the stem opening 104 is replaced by one or more openings 110 (hereinafter "actuator opening") which communicates chamber 102 and the passage 96 within the region of orifice 94 for purposes heretofore described. This form of the invention, i.e., the particular location of the means for communicating air to the liquid being dispensed, has particular applicability in the dispensing of liquids having high molecular weight in the range of about $10^5$ to about $10^6$ and a viscosity within the upper range of from about 3 to about 900 centipoises.

As may be seen in FIG. 3, each opening comprises a bore extending generally axially through the body of actuator 44 and cup 92. Each bore may be located along the length of the passage between orifice 94 and opening 98 from the stem of piston 46.

In the normal position of the actuator 44 (FIG. 1) the chamber 102 is open to the atmosphere. The chamber 102, however, may be sealed by virtue of a rib 106 formed on the sleeve 20 and the sliding action of the skirt 86 in the actuated direction (FIG. 2). O-ring structure or its equivalent may be used for this purpose, as desired. The body of the actuator serves as a cylinder operating around a piston formed by the hub 18 and forces the entrapped air through the stem opening 104 into the stem.

The volumetric quantity of liquid to be dispensed is determined by many factors including the length of stroke of the actuator. It is envisioned that the present dispenser will dispense a liquid volume required for the application to which it is adapted, such as about 65$\mu$l to about 700$\mu$l. In a dispenser which typically may dispense volumes of liquid of from about 65$\mu$l to about 160$\mu$l a stroke length of from about 0.139 to about 0.314 inches will suffice. An increase in this length will result in substantially a linearly related increase in the liquid volume dispensed with other factors remaining constant.

The operation of the dispenser should be apparent. However, briefly, downward movement of actuator 44 and the combined valve assembly 50 with pistons 46 and 48 results in the pressurization of chamber 30. When the pressure in chamber 30 overcomes the spring load of spring 52 the valve assembly and piston 46 commence movement at a greater velocity thereby to retract the spiked end 74 and open communication from the reservoir (not shown) for flow of liquid along the path illustrated by the arrows. Simultaneously, the air in chamber 102, once the seal at rib 106 is created, is pressurized and begins to flow through the communicating opening be it stem opening 104 (FIGS. 1 and 2) or actuator opening 110 (FIG. 3) which collectively are referred to as an "opening" or "orifice". The opening may be molded or cut into the respective structural component for communicating air under pressure from chamber 102.

As may be appreciated the opening is disposed so as to be fully open throughout the length of the stroke of the actuator. And, as also will be appreciated the skirt 86 of the actuator with slight modification of the body 12, i.e., the positioning of the rib 106 and a change in structure to support the cap 100, could telescope around the sleeve 20 for the same purpose.

Preferably, the skirt 86 of the actuator 44 should move downwardly through a distance approaching the distance of travel of the valve assembly 50 caused by driving movement of piston 46 before the seal of chamber 102 is created. Thereby, a build-up of pressure within the chamber will primarily be relieved by air flow past the rib 106. However, at least at the time that the pressure in chamber 30 overcomes the pressure of pressure spring 52 to cause the spiked end 74 of valve 72 to retract from seat 60 and allow flow of liquid the seal at rib 106 should have been made so that air under pressure enters the liquid stream to create turbulence and cause mechanical break-up. The length of the stroke of actuator 44 under the condition of seal of chamber 102 will be sufficient to inject a volume of air into the liquid stream which shall be equal to or more or less than the volume of liquid which is dispensed. Preferably the length of the stroke will be adjustable. The opening may be of any particular shape as would be convenient to mold or cut and may be of a cross-sectional area equal to that of a circle having a diameter of about 0.006 to about 0.020 inches. If there be a plurality of, say for example, three openings preferably they will be arranged equidistantly around the piston or at equidistant spacing in actuator 44 and provide an outlet into either the stem or passage for liquid flow to direct air along a line disposed in a chord or in generally coaxial paths so that mechanical break-up of liquid throughout a moving plane will be enhanced. The size of opening and the stroke length under conditions of chamber 102 being sealed should be selected so as not to interfere with the normal route of dispensing of the liquid through the orifice 94. The opening also should be selected so as not to cause excessive back pressure which, added to the spring load, would make the pump difficult to actuate.

As indicated, although not in a limiting sense but rather as exemplary, the cylinder is formed of polypropylene; whereas, while the other structure, preferably formed of plastic, may be of polyethylene either of low, medium or high density. Parts that interengage to provide a seal will be formed of a low to medium density. These include the actuator 44, piston 46 and a gasket 108 between the body 12 and the neck of the bottle. The body 12 will be of polypropylene for added strength and the piston 48 is of a high density polyethylene for better support of the compression spring 52. The valve assembly 50 and cup 92 may be of Celcon. The valve 78 may be formed of a nickel plated steel, 30006 (Stainless Steel type 302) and the cap 100 may be formed of styrene.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

What is claimed is:

1. A dispenser for communicating both a liquid from a reservoir of a receptacle and a pressurized fluid carrier from an air pump chamber to a flow path and passing a liquid in an atomized state from an exit orifice comprising:

(a) a housing adapted for receipt on said receptacle;

(b) a liquid pumping mechanism, said liquid pumping mechanism carried by said housing and including (1) a liquid pump chamber adapted for communication with said reservoir, (2) a piston movable in said liquid pump chamber and including a hollow stem defining a portion of said flow path, (3) a valve seat in said stem, (4) a valve in said liquid pump chamber adapted for movement relative to said valve seat to control communication of liquid from said liquid pump chamber to said flow path, (5) a spring urging said piston and valve in one direction whereby said valve moves into said valve seat, and (6) an actuator mounted on said stem for moving said piston in the other direction to pressurize said liquid pump chamber, which pressure acts on said valve to overcome the force of said spring whereby said valve moves in said other direction relative to said piston and out of said valve seat;

(c) an air pumping mechanism including said air pump chamber, said air pump chamber defined by a wall of said housing continuous around said stem and a skirt of said actuator juxtaposed to said wall, one of said wall and skirt having sealing means cooperating therebetween so that said air pump chamber which normally is open to atmosphere is sealed when said actuator is moved relative to said wall in said other direction and the air therein is compressed; and, (d) a plurality of openings formed in said stem, said openings disposed equiangularly around said stem and arranged thereby to direct air under pressure and along multiple paths into said flow path to enhance mechanical break-up and atomization of liquid flowing therein.

2. The dispenser of claim 1 wherein each opening is of a size whereby the total volume of compressed air directed into said flow path is substantially equal to the volume of liquid being dispensed.

3. The dispenser of claim 2 wherein each opening of said plurality of openings is of a size equal to the area of a circle having a diameter of between about 0.003 and about 0.020 inch.

* * * * *